US005538487A

United States Patent [19]

Fulmer

[11] Patent Number: 5,538,487

[45] Date of Patent: Jul. 23, 1996

[54] ISOMETRIC EXERCISE

[76] Inventor: Eric W. Fulmer, R.R. 1 Box 392, Greensburg, Pa. 15601-9801

[21] Appl. No.: 373,871

[22] Filed: Jan. 17, 1995

Related U.S. Application Data

[63] Continuation of Ser. No. 122,067, Sep. 17, 1993, abandoned.

[51] Int. Cl.[6] ..... A63B 3/00

[52] U.S. Cl. ..... 482/42; 482/41; 482/91

[58] Field of Search ..... 482/35–42, 91; 182/194

[56] References Cited

U.S. PATENT DOCUMENTS

| | | | |
|---|---|---|---|
| 2,632,592 | 3/1953 | Eisman | 182/194 |
| 3,207,511 | 9/1965 | Hoffman | 482/104 X |
| 3,472,509 | 10/1969 | Flynn | 482/36 |
| 3,506,261 | 4/1970 | Gregory | 482/37 |
| 3,572,698 | 3/1971 | Greenly | 482/36 |
| 3,642,278 | 2/1972 | Hinckley | 482/38 |
| 3,643,942 | 2/1972 | Williams | 482/36 |
| 3,891,207 | 6/1975 | Helliwell | 482/38 X |
| 4,252,313 | 2/1981 | Skalka | 482/36 |
| 4,286,782 | 9/1981 | Fuhrhop | 482/41 X |
| 4,781,374 | 11/1988 | Lederman | 482/38 X |
| 4,846,458 | 7/1989 | Potts | 482/41 |
| 4,850,589 | 7/1989 | Block | 482/36 |
| 4,973,051 | 11/1990 | Stater | 482/104 |
| 5,050,868 | 9/1991 | Pearson | 482/104 X |
| 5,156,580 | 10/1992 | Holland et al. | 482/39 |

FOREIGN PATENT DOCUMENTS

| | | | |
|---|---|---|---|
| 1258754 | 9/1989 | Canada | 482/41 |

*Primary Examiner*—Richard J. Apley
*Assistant Examiner*—John Mulcahy

[57] ABSTRACT

An isometric exercise bar having a base and a pair of substantially triangular planar uprights mounted on opposite sides of the base. The tops of the uprights are connected by a tie bar. A plurality of apertures runs along the forward and rearward edges of the uprights. A second bar is adjustably positioned between the uprights within an aligned pair of apertures.

2 Claims, 4 Drawing Sheets

FIG. 3
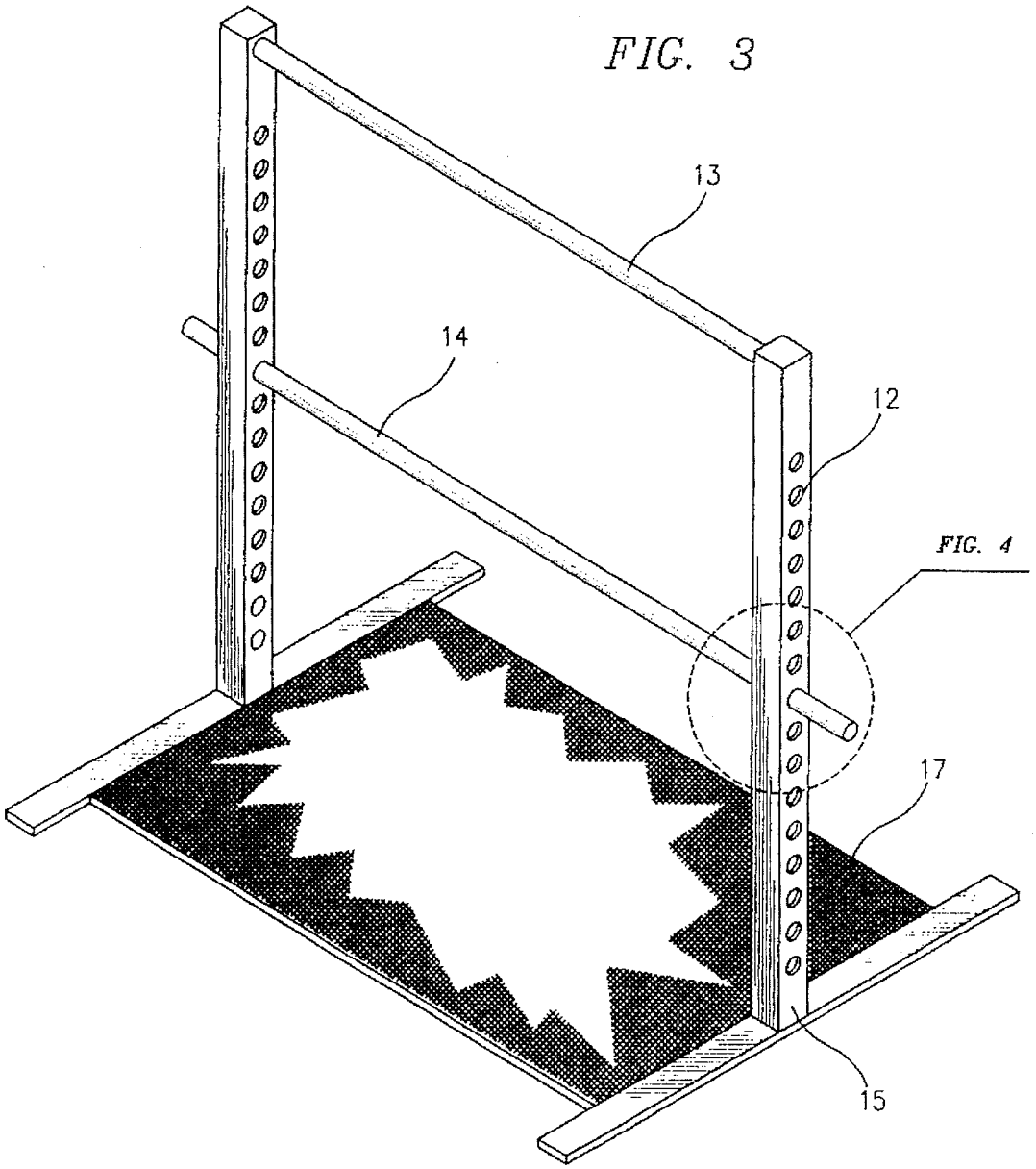
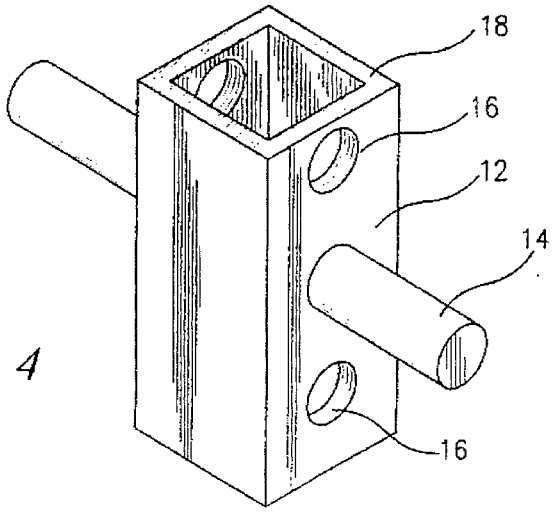
FIG. 4

ISOMETRIC EXERCISE

This application is a continuation of application 08,122,067, filed Sep. 17, 1993, now abandoned.

BACKGROUND OF THE INVENTION

1. Field of the Invention

The present invention relates to exercise apparatus and more particularly pertains to apparatus which is especially designed for isometric exercise.

2. Description of the Prior Art

Isometric exercising in its simplest form consists of exerting body pressure against a fixed, stationary surface. Most generally this is done by pushing against a wall or floor. Some types of equipment have been developed as shown, for example, in U.S. Letters Pat. Nos. 4,882,677; 4,607,841; and 5,033,741. More specifically, such equipment heretofore devised and utilized for the purpose of isometric exercise are known to consist basically of familiar, expected and obvious structural configurations, and do not provide an equivalent to the wall pushing type of exercise notwithstanding the myriad of designs encompassed by the crowded prior art which have been developed for the fulfillment of countless objectives and requirements.

In this respect, the apparatus according to the present invention substantially departs from the conventional concepts and designs of the prior art, and in so doing provides an apparatus primarily developed for the purpose of allowing the user to perform a variety of isometric exercises using transverse hand positioning.

Therefore, it can be appreciated that there exists a continuing need for new and improved isometric exercise apparatus which can be used for a variety of exercises. In this regard, the present invention substantially fulfills this need.

SUMMARY OF THE INVENTION

In view of the foregoing disadvantages inherent in the known types of exercise machines now present in the prior art, the present invention provides an improved construction wherein the same can be utilized for a variety of isometric exercises. As such, the general purpose of the present invention, which will be described subsequently in greater detail, is to provide a new and improved isometric exercise apparatus which has all the advantages of the prior art devices and none of the disadvantages.

To attain this, the present invention essentially relates to an isometric exercise apparatus comprising a rigid stand having a non-skid base plate; a pair of rigid uprights extending upwardly from the sides of said baseplate; a bar affixed rigidly between the tops of said uprights; and a rigid bar extendible between said uprights and adjustable at a plurality of positions vertically disposed from said base plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved isometric exercise apparatus which has all the advantages of the prior art devices and none of the disadvantages.

It is another object of the present invention to provide a new and improved isometric exercise apparatus which may be easily and efficiently manufactured and marketed.

It is a further object of the present invention to provide a new and improved isometric exercise apparatus which is of a durable and reliable construction.

An even further object of the present invention is to provide a new and improved isometric exercise apparatus which is susceptible of a low cost of manufacture with regard to both materials and labor, and which accordingly is then susceptible of low prices of sale to the consuming public, thereby making such apparatus economically available to the buying public.

Still yet another object of the present invention is to provide a new and improved isometric exercise apparatus which provides in the apparatuses and methods of the prior art some of the advantages thereof, while simultaneously overcoming some of the disadvantages normally associated therewith.

Still another object of the present invention is to provide a new and improved isometric exercise apparatus which provides for transverse positioning of the hands.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a perspective view of the apparatus of FIG. 1.

FIG. 4 is an enlarged detail perspective view of the area circled at "4" on FIG. 3.

DESCRIPTION OF THE PREFERRED EMBODIMENT

Figure 1:
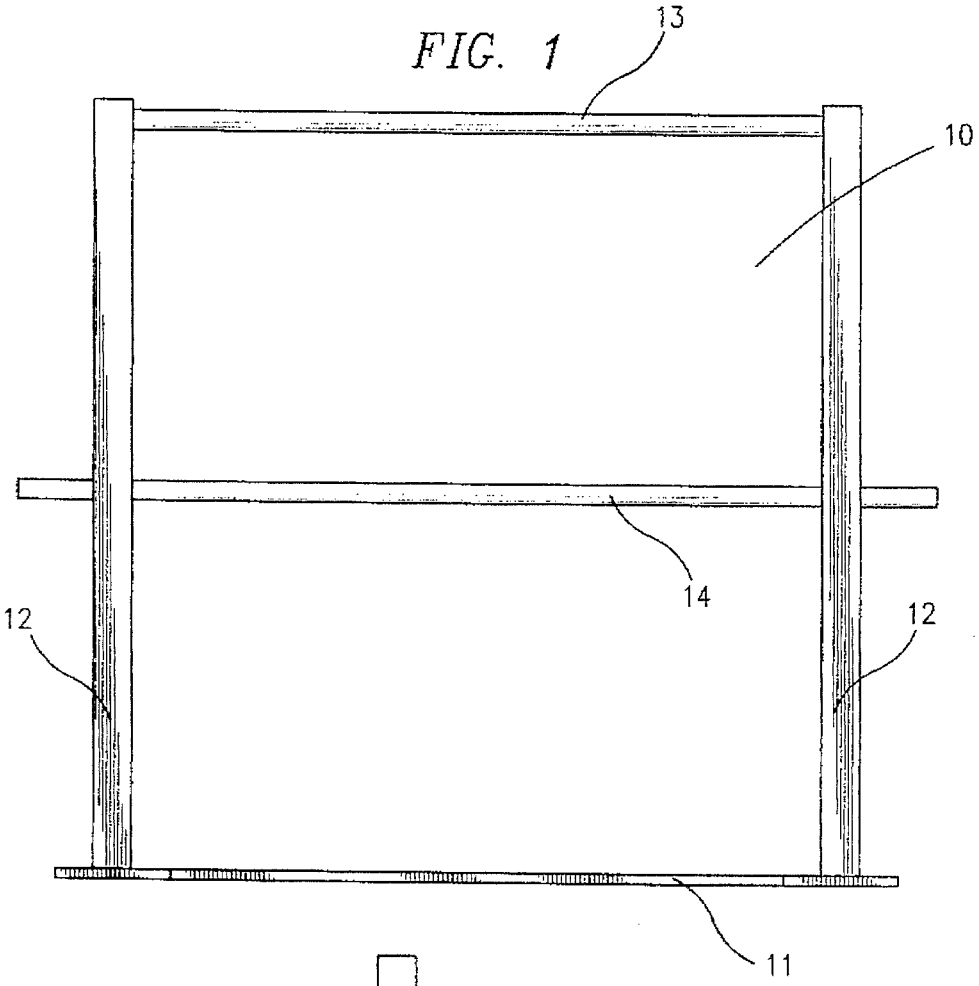
FIG. 1 is a front plan view of the apparatus of the present invention.

With reference now to the drawings, and in particular to FIG. 1 thereof, a new and improved isometric exercise apparatus embodying the principles and concepts of the present invention and generally designated by the reference numeral 10 will be described.

Figure 2:
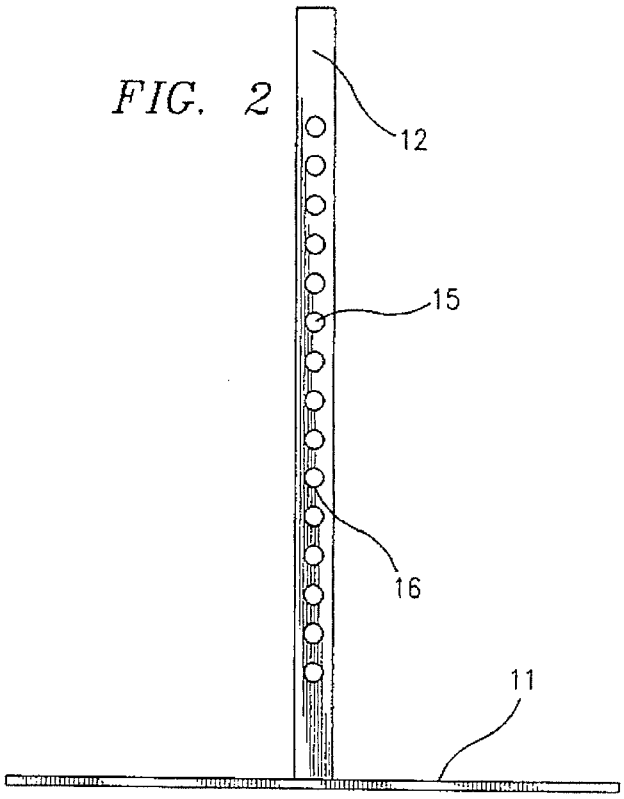
FIG. 2 is a side elevation of the apparatus of FIG. 1.

The apparatus consists of a base plate 11 and a pair of vertical upright members 12 affixed rigidly to the base plate 11. Extending between and affixed to the upper ends of members 12 is a rigid cross tie bar 13. Together with the base plate 11, cross bar 13 ties the structure 10 into a rigid whole. Positioned in a vertically adjustable manner between said uprights 12 is a removable rigid bar member 14. As shown in FIG. 2, such bar 14 is adjustable to a variety of elevations by means of apertures 15 spaced upwardly from base member 11 and extending through each of upright members 12, said apertures forming at their base, support ledges 16 for bar 14.

The entire structure 10 is more clearly shown in FIG. 3 wherein it is also illustrated that base 11 has a non-skid surface 17 thereon. As shown in the enlarged detail of FIG. 4, the uprights 12 are preferably composed of a square channel 18 formed of steel or a similar rigid material. This permits a pair of in-line apertures 15 in each upright member 12, providing more rigid support for bar 14 slidably removable therein.

Figure 5:
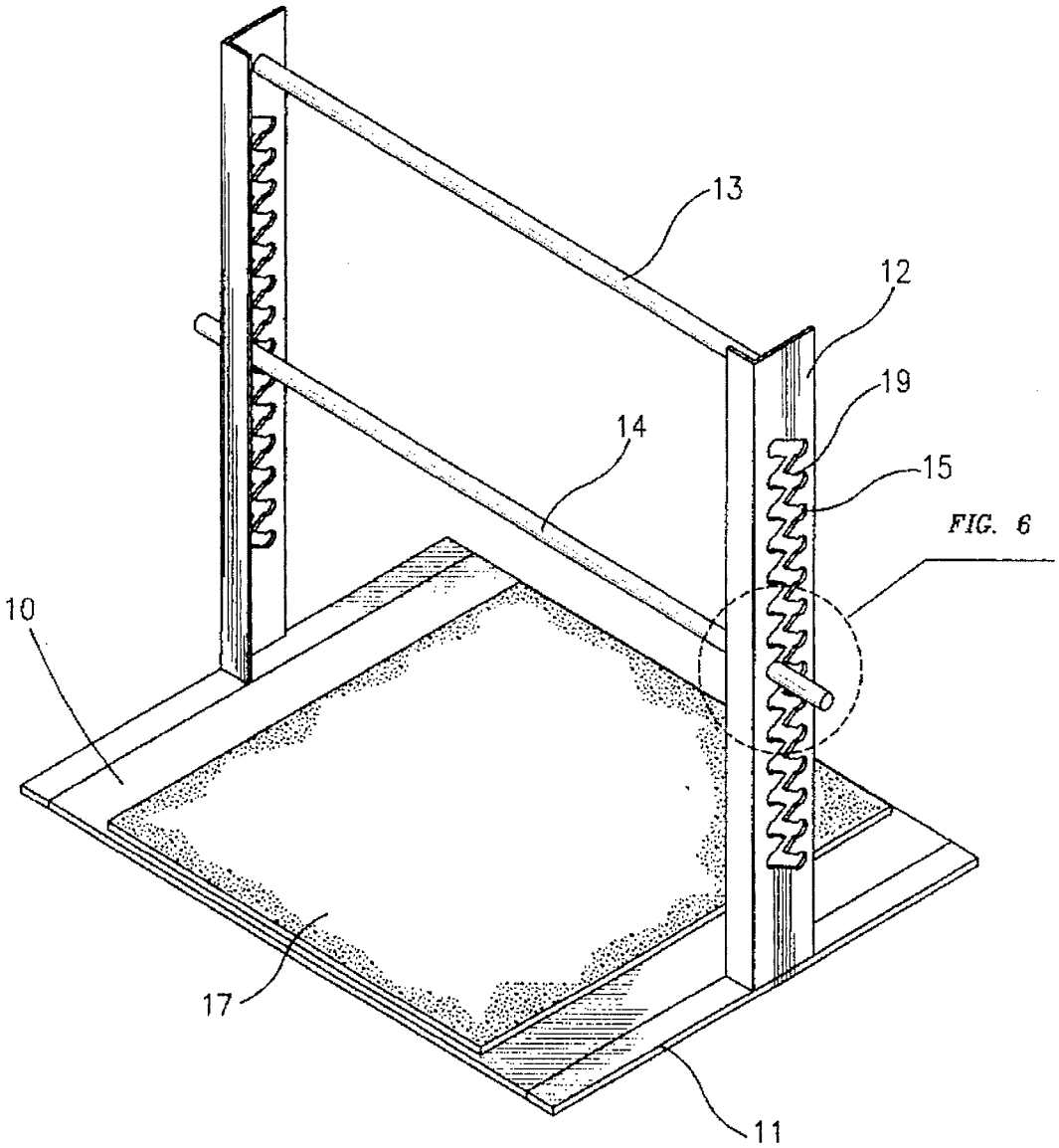
FIG. 5 is a perspective view of a modified version of the apparatus of FIGS. 1–4.
Figure 6:
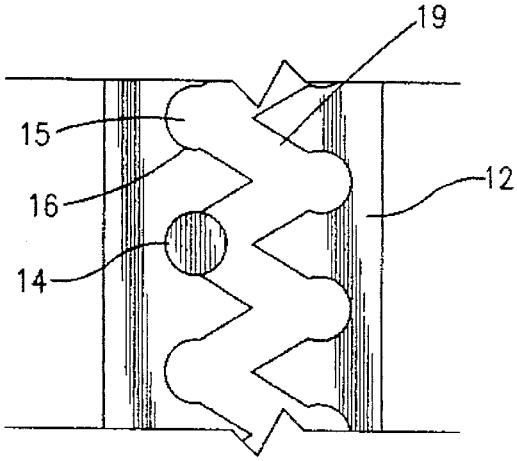
FIG. 6 is an enlarged detail perspective view of the area circled at "6" on FIG. 5.

FIGS. 5 and 6 illustrate a modification of the support means for bar 14 in that the apertures 15 are inter-connected with a channel 19 so that bar 14 may be positioned at various points without having to remove such bar 14 from the upright support member 12.

Figure 7:
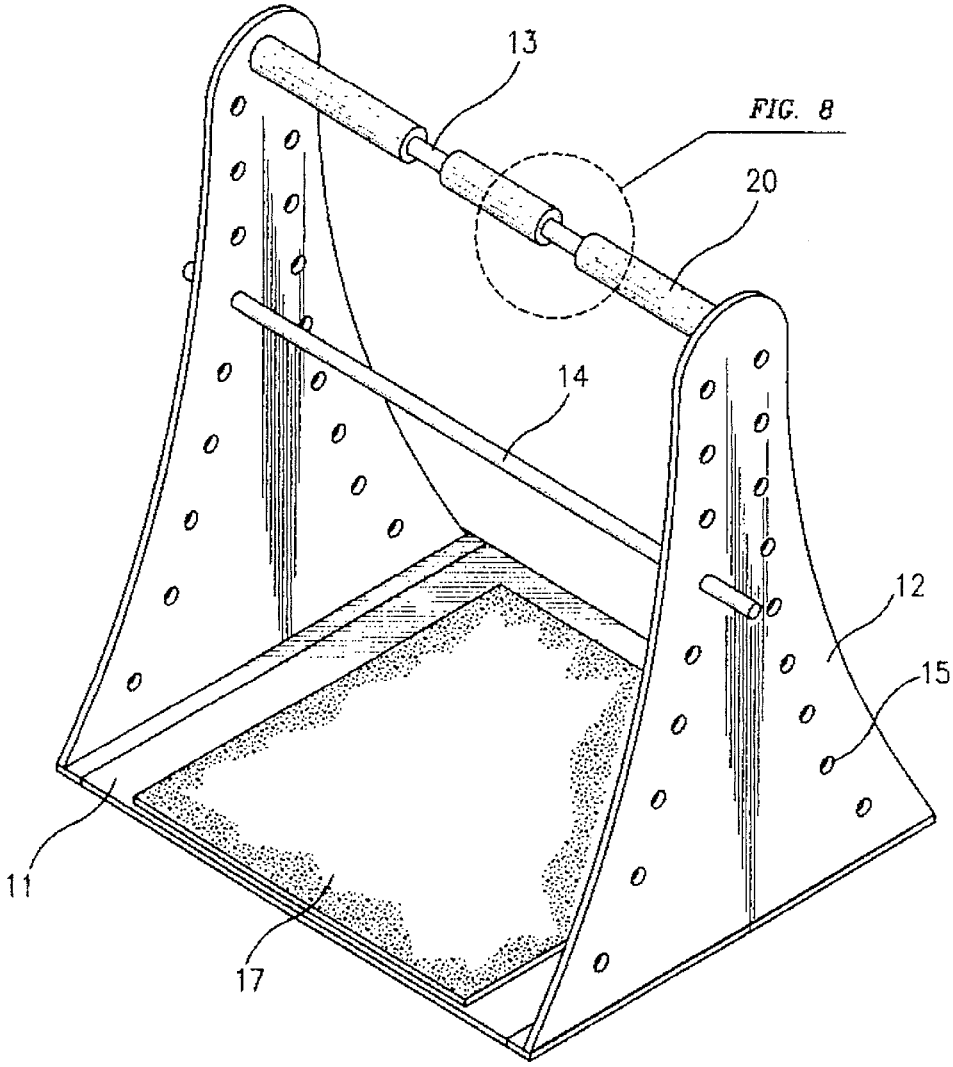
FIG. 7 is a perspective view of yet another modification of the invention.
Figure 8:
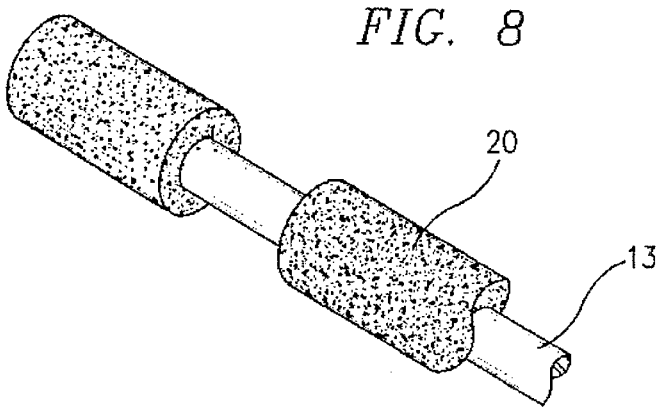
FIG. 8 is an enlarged detail view of the area identified as "8" in FIG. 7.

FIG. 7 illustrates the use of wider side uprights 12 which permits some lateral as well as vertical displacement positions for bar 14 due to the positioning of apertures 15. Likewise, as shown in FIG. 7 and 8, the tie bar 13 may be utilized as an exercise bar by fitting cushioned hand grips 20 thereover.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An isometric exercise growth bar comprising:

a substantially rectangular base plate having a first side and a second side;

a first upright member having a substantially triangular, planar shape, said first upright member having a forward edge, a rearward edge, a top edge, and a bottom edge, with said bottom edge being orthogonally coupled to said base plate at said first side of said base plate, said first upright member further having a plurality of forward edge apertures extending through said first upright member and positioned proximate said forward edge, and a plurality of rearward edge apertures extending through said first upright member and positioned proximate said rearward edge;

a second uprights member having a substantially triangular, planar shape, said first upright member having a forward edge, a rearward edge, a top edge, and a bottom edge, with said bottom edge being orthogonally coupled to said base plate at said second side of said base plate, said second upright member further having a plurality of forward edge apertures extending through said first upright member and positioned proximate said forward edge, and a plurality of rearward edge apertures extending through said second upright member and positioned proximate said rearward edge, said forward edge apertures of said first upright member being aligned with said forward edge apertures of said second upright member and said rearward edge apertures of said first upright member being aligned within said rearward edge apertures of said second upright member;

a substantially cylindrically shaped linear tie bar having a center portion, and first and second ends, said tie bar extending between said first upright member and said second upright member, said tie bar being coupled at said first ends thereof to said upright members proximate said top edges thereof;

a first hand grip mounted concentrically about said center portion of said tie bar to cover said center portion of said tie bar;

a second hand grip mounted concentrically about a first portion of said tie bar positioned between said center portion and said first end of said tie bar to cover said first portion, said second hand grip being spaced from said first hand grip so as to expose a second portion of said tie bar;

a third hand grip mounted concentrically about a third portion of said tie bar positioned between said center portion and said second end of said tie bar to cover said third portion, said third hand grip being spaced from said first hand grip so as to expose a fourth portion of said tie bar;

and, a bar member removably positioned within an individual one of said plurality of apertures of said first upright member and an individual one of said plurality of apertures of said second upright member;

wherein only said tie bar, said base plate, and said bar member extend between said upright members such that an individual can stand on said base plate between said first upright member and said second upright member to grasp said bar member and said tie bar.

2. An isometric exercise growth bar as recited in claim 1, and further comprising a non skid surface coupled to said base plate.

* * * * *